US006964339B2

(12) United States Patent
Meyer

(10) Patent No.: US 6,964,339 B2
(45) Date of Patent: Nov. 15, 2005

(54) SHOCK ABSORBING CONTAINER

(75) Inventor: John S. Meyer, Hillsboro, OR (US)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/320,010

(22) Filed: Dec. 16, 2002

(65) Prior Publication Data

US 2004/0112788 A1 Jun. 17, 2004

(51) Int. Cl.[7] ..... B65D 81/02

(52) U.S. Cl. ..... 206/594; 206/521; 206/590; 206/825

(58) Field of Search ..... 206/589–591, 206/594, 521, 523, 784, 825, 521.15, 521.3, 206/521.4, 706, 707, 418–420; 267/1.5, 81, 267/141, 148, 158, 160

(56) References Cited

U.S. PATENT DOCUMENTS

| | | | | | |
|---|---|---|---|---|---|
| 987,958 | A | * | 3/1911 | Clenny et al. | 206/521 |
| 2,377,604 | A | * | 6/1945 | Belden | 206/590 |
| 2,742,219 | A | * | 4/1956 | Van Antwerpen | 206/591 |
| 2,979,248 | A | | 4/1961 | Washington | |
| 3,144,188 | A | | 8/1964 | Gallistel | |
| 4,247,289 | A | | 1/1981 | McCabe | |
| 4,293,070 | A | | 10/1981 | Ohlbach | |
| 4,363,579 | A | | 12/1982 | Rogers | |
| 4,594,492 | A | * | 6/1986 | Maroszek | 206/591 |
| 4,865,200 | A | | 9/1989 | Sullivan et al. | |
| 4,954,385 | A | | 9/1990 | Sämann | |
| 5,045,330 | A | * | 9/1991 | Pawlowski | 426/107 |
| 5,088,601 | A | | 2/1992 | Seefeldt | |
| 5,121,838 | A | | 6/1992 | Dickie | |
| 5,223,121 | A | | 6/1993 | Dickie et al. | |
| 5,303,820 | A | | 4/1994 | Comtois | |
| 5,484,241 | A | | 1/1996 | Haywood et al. | |
| 5,484,519 | A | | 1/1996 | Fenton et al. | |
| 5,529,187 | A | | 6/1996 | Denola | |
| 5,613,610 | A | | 3/1997 | Bradford | |
| 5,823,352 | A | | 10/1998 | Mena et al. | |

* cited by examiner

*Primary Examiner*—Mickey Yu
*Assistant Examiner*—J. Gregory Pickett
(74) *Attorney, Agent, or Firm*—Mark P. Watson

(57) ABSTRACT

A shock absorbing container assembly for packaging articles, including an outer container, a sheet member, and an article container. In the closed configuration, the outer container includes an inner top surface and an opposed inner bottom surface that are substantially fixedly spaced apart in a vertical axis. The sheet member has a bottom surface and at least one preformed foldable portion that is folded away from the bottom surface terminating at a free distal edge. The free distal edge bears against the top surface of the outer container when receiving vertically directed forces transmitted by the top surface. The article container for receiving articles is disposed inside the outer container and includes a plurality of intersecting walls. Vertically directed forces transmitted by the sheet member are received by at least two of the walls that have upper ends bearing against the bottom surface of the sheet member and lower ends bearing against the bottom surface of the outer container. The walls, by intersecting with each other, support one another to maintain the walls upright so that the walls are enabled to support the vertically directed forces transmitted by the sheet member.

12 Claims, 10 Drawing Sheets

SHOCK ABSORBING CONTAINER

FIELD OF INVENTION

The present invention relates to the field of containers and more particularly to a shock absorbing container.

BACKGROUND OF INVENTION

When stacked or handled, a container can experience forces or shocks in the side-to-side or front-to-back ("horizontal") direction or in the up or down ("vertical") direction. Fragile articles stored in the container, such as circuit boards, can be damaged as a result of forces or shocks. Thus, there is a need to protect articles stored in the container from forces and shocks.

To protect articles, a cellular structure can be placed in the interior of a container, such as the exemplary cellular structure shown in FIG. 1. FIG. 2 shows the cellular structure of FIG. 1 placed within a container. A number of articles may be placed in the shown cellular structure; typically, one article per cell. Generally, articles are not placed in the outer cells. The outer cells serve to protect articles in the inner cells from horizontal forces or shocks. The cellular structure by itself, however, does not provide protection from vertical forces or shocks.

In order to protect the contents from vertical forces and shocks, a polymer foam cushion may be employed at the top or the bottom of the container. The cellular structure shown in FIGS. 1–2 has a recessed rectangular area that is adapted to receive a rectangular polymer foam cushion, such as the one shown in FIG. 3. FIG. 4 shows, in cross-section, the container and cellular structure of FIGS. 1–2 which additionally includes the polymer foam cushion of FIG. 3. Polymer foam, however, is expensive. In addition, recycling polymer foam is complicated and recycling facilities are not always available. Further, containers that employ polymer foam cushions may be difficult to assemble.

FIGS. 5–6 show another method for protecting the contents of a container from vertical forces and shocks. FIG. 5 shows an exemplary folded corrugated board that may be employed inside a container. FIG. 6 shows a cross-sectional view of a container having a pair of folded corrugated boards. The dashed line represents one or more articles in the container. Each folded corrugated board includes a vertical section parallel to a container wall that remains stationary, an end section that projects over the article at an angle above the horizontal, and a fold or score at the junction of the two sections. When the lid experiences a vertical force or shock, the end section bends inward about the fold providing cushioning. As the shown folded corrugated board bends down, however, the end section can contact the articles in the container. This can result in the force or shock being transferred directly to the articles. Moreover, containers that employ folded corrugated board may be difficult to assemble.

Accordingly, there is a need for shock absorbing container in which articles packaged within the container are protected from vertical forces and shocks.

BRIEF SUMMARY OF THE INVENTION

Disclosed herein is a shock absorbing container. Within the scope of the invention is a shock absorbing container assembly for packaging one or more articles, including an outer container, a sheet member, and an article container. The outer container has a closed configuration for shipping the articles. In the closed configuration, the outer container includes an inner top surface and an opposed inner bottom surface that are substantially fixedly spaced apart in a vertical axis. The sheet member has a bottom surface and at least one preformed foldable portion. The preformed foldable portion is folded away from the bottom surface of the sheet member and terminates at a free distal edge. The free distal edge bears against the top surface of the outer container when receiving vertically directed forces transmitted by the top surface. The article container is disposed inside the outer container and is for receiving articles. The article container includes a plurality of intersecting walls so that, when receiving vertically directed forces transmitted by the sheet member at least two of the walls have upper ends bearing against the bottom surface of the sheet member and lower ends bearing against the bottom surface of the outer container. The walls, by intersecting with each other, support one another to maintain the walls upright so that the walls are enabled to support the vertically directed forces transmitted by the sheet member.

In one preferred embodiment, the sheet member is formed of corrugated paperboard.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

This detailed description of a preferred embodiment is organized as follows: First, the exemplary prior art packaging methods shown in FIGS. 1–6 are described in detail. Second, the present invention is discussed with reference to FIGS. 7–17. Finally, the meaning of some of the terms and phrases used herein are discussed.

Figure 1:
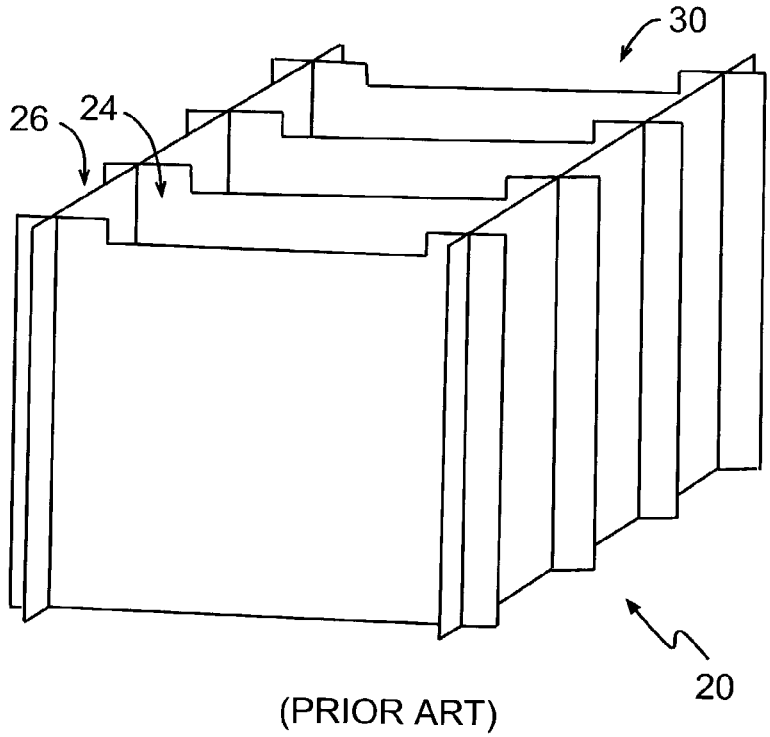
(PRIOR ART) FIG. 1
FIG. 1 illustrates a prior art cellular structure.
Figure 2:
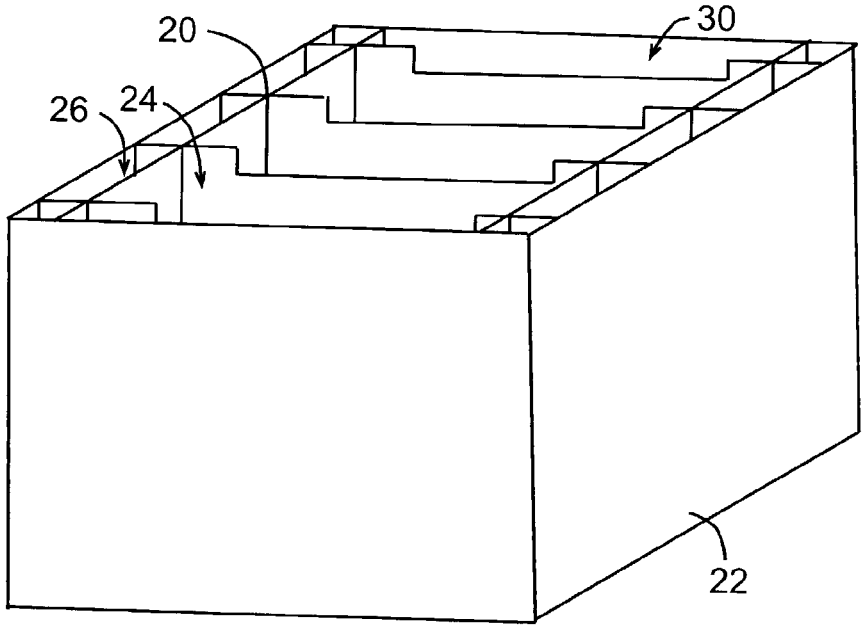
(PRIOR ART) FIG. 2
FIG. 2 illustrates the cellular structure of FIG. 1 within a container.

FIG. 1 illustrates an exemplary cellular structure 20. FIG. 2 shows the cellular structure 20 of FIG. 1 within a container 22. A number of articles may be placed in the shown cellular structure 20; typically, one article per inner cell 24. Generally, articles are not placed in the outer cells 26. The cellular structure 20 does not provide protection from vertical forces or shocks.

Figure 3:
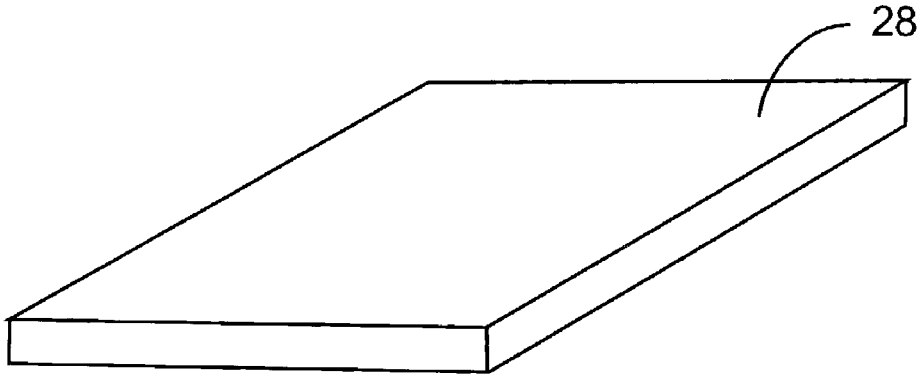
(PRIOR ART) FIG. 3
FIG. 3 illustrates a prior art polymer foam cushion.

FIG. 3 illustrates a polymer foam cushion 28 that may be employed at the top or the bottom of a container to protect the contents from vertical forces and shocks. The cellular structure shown in FIGS. 1–2 has a recessed rectangular area 30 that is adapted to receive the polymer foam cushion 28. Polymer foam is expensive and can be difficult to recycle.

Figure 4:
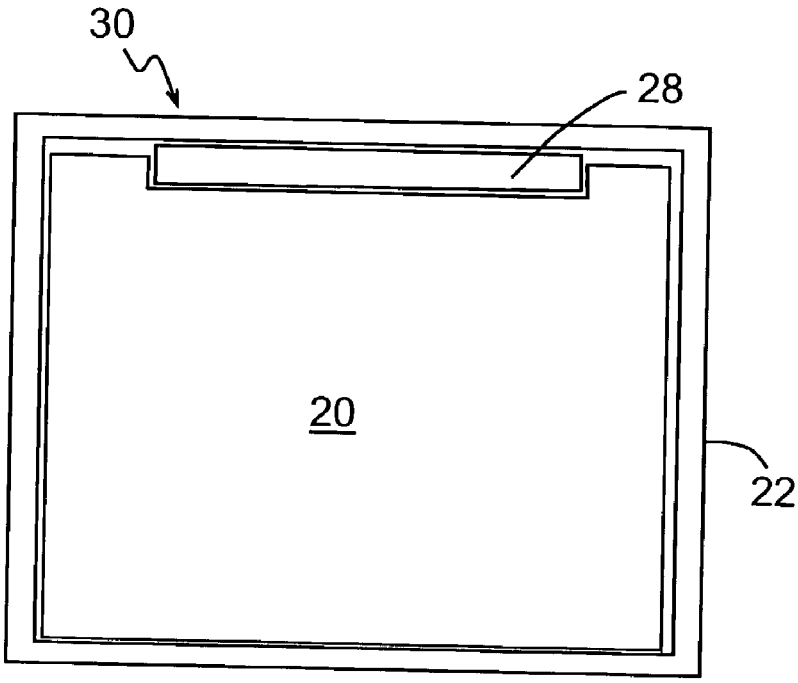
(PRIOR ART) FIG. 4
FIG. 4 is a cross-sectional view the polymer foam cushion of FIG. 3 disposed within the cellular structure and container of FIG. 2.

FIG. 4 shows, in cross-section, the cellular structure 20, the container 22, and the polymer foam cushion 28 disposed in recessed area 30.

Figure 5:
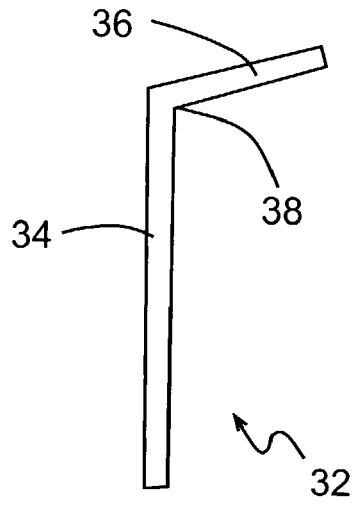
(PRIOR ART) FIG. 5
FIG. 5 illustrates a prior art folded corrugated board.

FIG. 5 illustrates an exemplary folded corrugated board 32 that may be employed inside a container 40. The folded corrugated board 32 includes a vertical section 34, an end section 36, and a fold 38 at the junction of the two sections.

Figure 6:
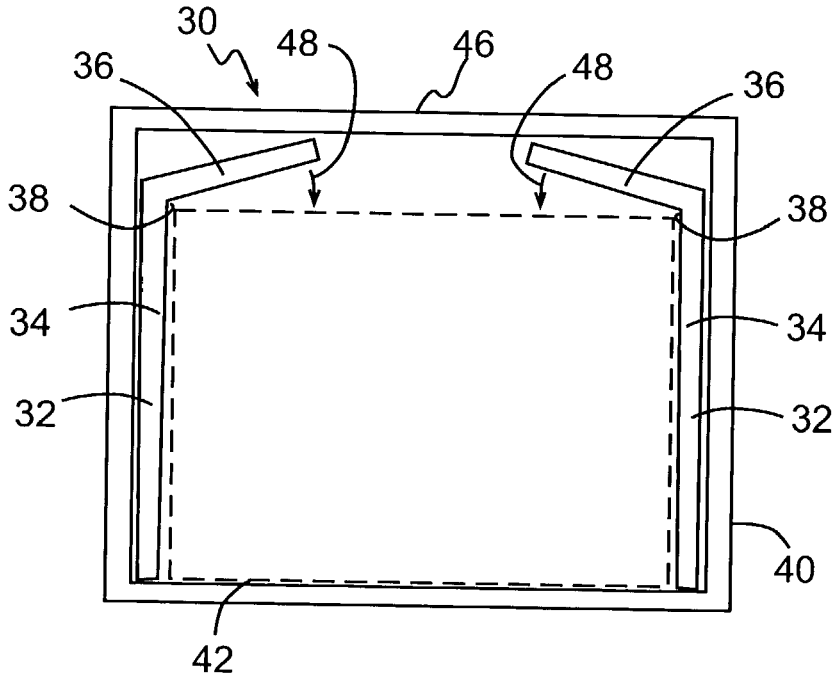
(PRIOR ART) FIG. 6
FIG. 6 is a cross-sectional view of a pair of the folded corrugated boards of FIG. 5 disposed within a container.

FIG. 6 shows a cross-sectional view of a container 40 having a pair of folded corrugated boards 32. The dashed line represents an article 42 within the container. The vertical sections 34 of each folded corrugated board 32 are parallel to the side walls of the container 40. The end section 36 projects over the article 42 at an angle above the horizontal. When the top side 46 receives a vertical force or shock, the end section 36 bends down about the fold 38 in the direction of arrows 48. When the end section 36 bends down, it can contact the article 42. If end section 36 does contact the article 42, the vertical force or shock will be transferred to the article 42.

Turning now to FIGS. 7–16, preferred embodiments of a shock absorbing container assembly according to the present invention are illustrated. The present invention provides protection from vertical forces and shocks without relying on polymer foam. Moreover, vertical forces or shocks are not transferred to the article. The shock absorbing container assembly includes three components: an outer container, a sheet member, and an article container.

Figure 7:
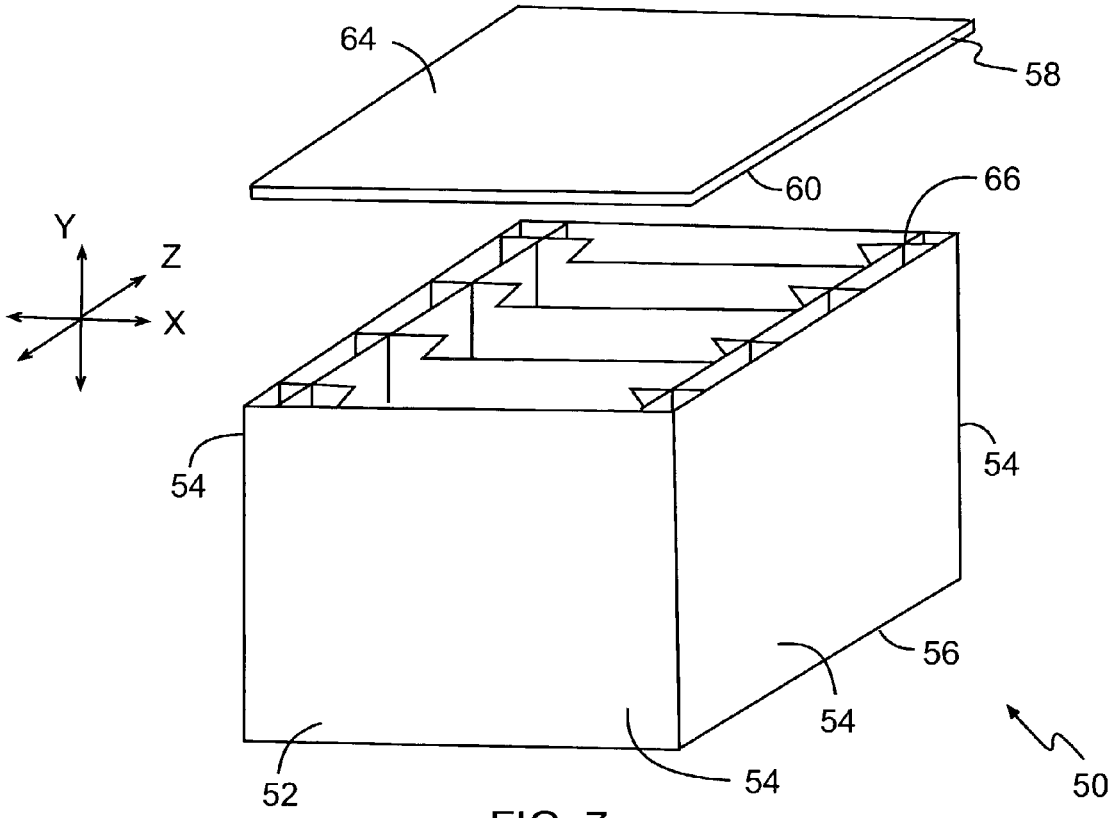
FIG. 7 illustrates a shock absorbing container assembly that includes an outer container and an article container having notched and reverse notched partitions according to the present invention.

FIG. 7 illustrates a preferred embodiment of a shock absorbing container assembly 50 that includes one preferred embodiment of an outer container 52 having four side walls 54, a bottom side 56, and a lid 58. The side walls 54 define a vertical ("y") axis. The outer container 52 also includes an inner bottom surface 62 (not shown). The inner bottom surface 62 is opposite bottom side 56. The shown lid 58 is removable. Alternatively, the lid 58 may be hingedly attached to the outer container 52. As such, the shock absorbing container assembly 50 has two configurations: a closed configuration when the lid 58 is disposed as a top side of the outer container 52 and an open configuration when the lid 58 is not so disposed. In the closed configuration, the outer container 52 additionally includes an inner top surface 60. The inner top surface 60 is opposite a top side 64 of the lid 58. The inner top surface 60 and the inner bottom surface 62 are substantially fixedly spaced apart in the vertical axis by a distance defined by the height of the side walls 54. One preferred embodiment of an article container 66 is disposed within the outer container 52.

Figure 8:
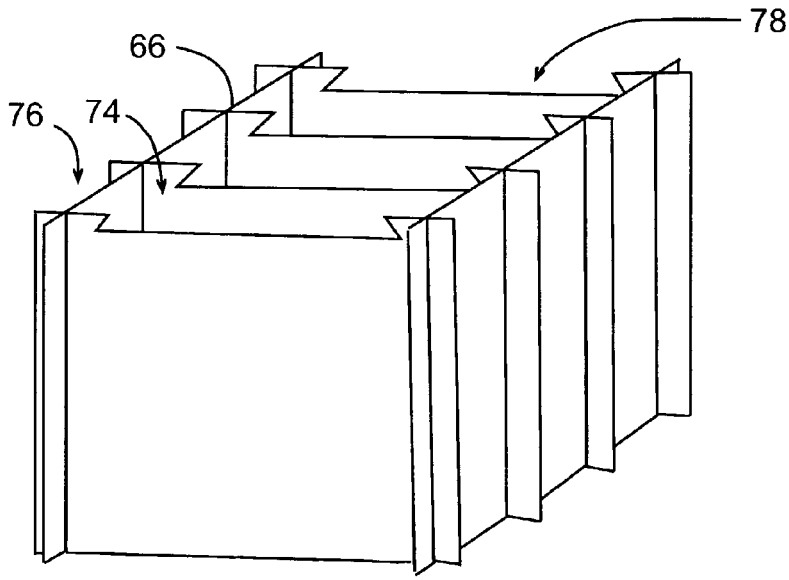
FIG. 8 illustrates the article container of FIG. 7.

FIG. 8 illustrates the article container 66. The article container 66 has a plurality of intersecting walls. The intersection of one wall with another maintains both walls in an upright position. Each wall provides support to the other by means of the coupling provided by the intersection. For example, if a vertical force or shock is exerted on an upper end of a wall, the wall will maintain its upright position through the support provided by the intersection. Of course, there is a limit to the amount of support that can be provided and normally the intersection of two corrugated board walls will not prevent crushing should a sufficient vertical force be applied.

Figure 9:
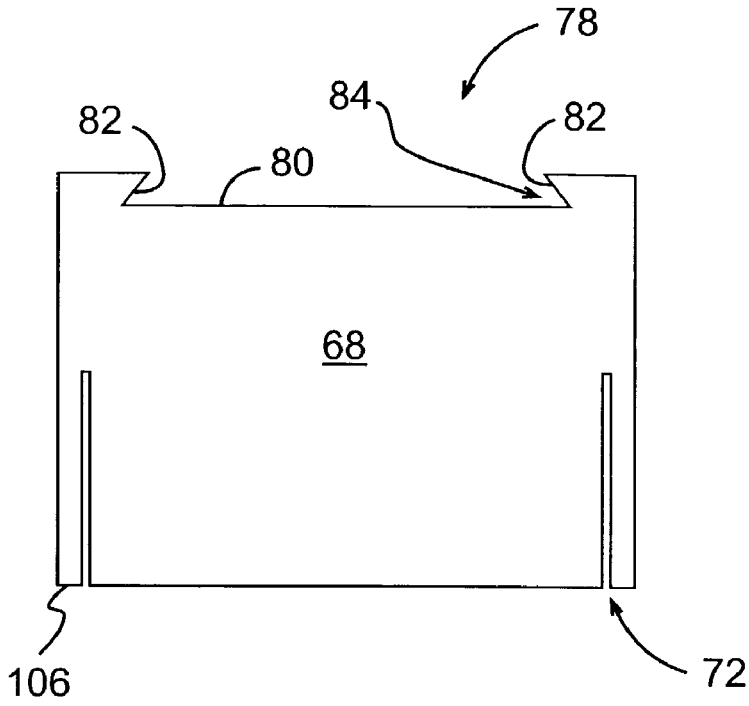
FIG. 9 shows a reverse notched partition of the article container of FIG. 8
Figure 10:
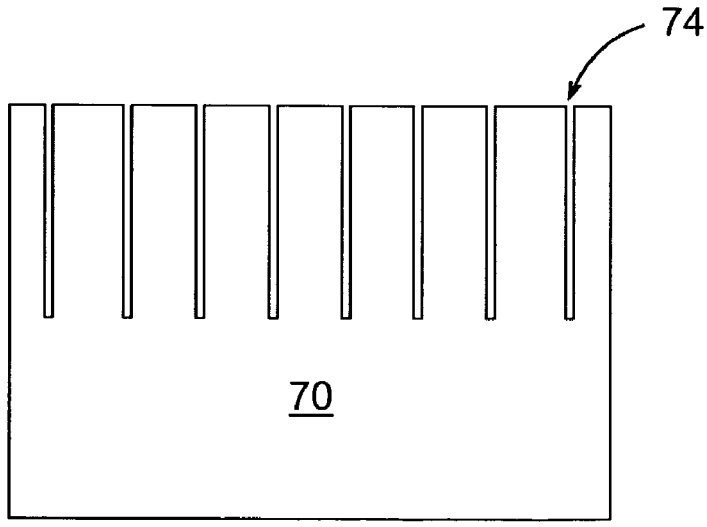
FIG. 10 shows a notched partition of the article container of FIG. 8.

The shown article container 66 is assembled from two types of partitions that are shown in FIGS. 9–10. FIG. 9 shows a reverse notched partition 68. FIG. 10 shows a notched partition 70. Generally, an article container 66 includes two or more parallel reverse notched partitions 68 and at least two parallel notched partitions 70. Notches 72 in the reverse notched partition 68 are received in appropriate notches 74 of the notched partition 70. When assembled, the reverse notched and notched partitions 68, 70 are at right angles to each other. There is generally one more reverse notched partition 68 than the total number of articles. Referring to FIG. 8, articles are placed in cells 74, but not in the outer cells 76 as these cells are intended to protect the articles from horizontal forces or shocks (along the x and z axis).

Other embodiments for forming the plurality of intersecting walls of the article container 66 are contemplated. In an alternative embodiment, a single sheet of material may be folded to form two or more intersecting walls. In yet another embodiment, the partitions can be formed by the use of adhesive material, such as glue. Moreover, the intersecting walls can be made from a plurality of parts or cut-outs.

The article container 66 also includes a sheet member holding recess 78 that is formed from a plurality of reverse notched partitions 68. Referring to FIG. 9, the sheet member holding recess 78 on each reverse notched partitions 68 has an upper end 80 and a pair of inclined edges 82. An acute angle 84 defines the relation between the upper end 80 and the inclined edge 82.

Figure 11:
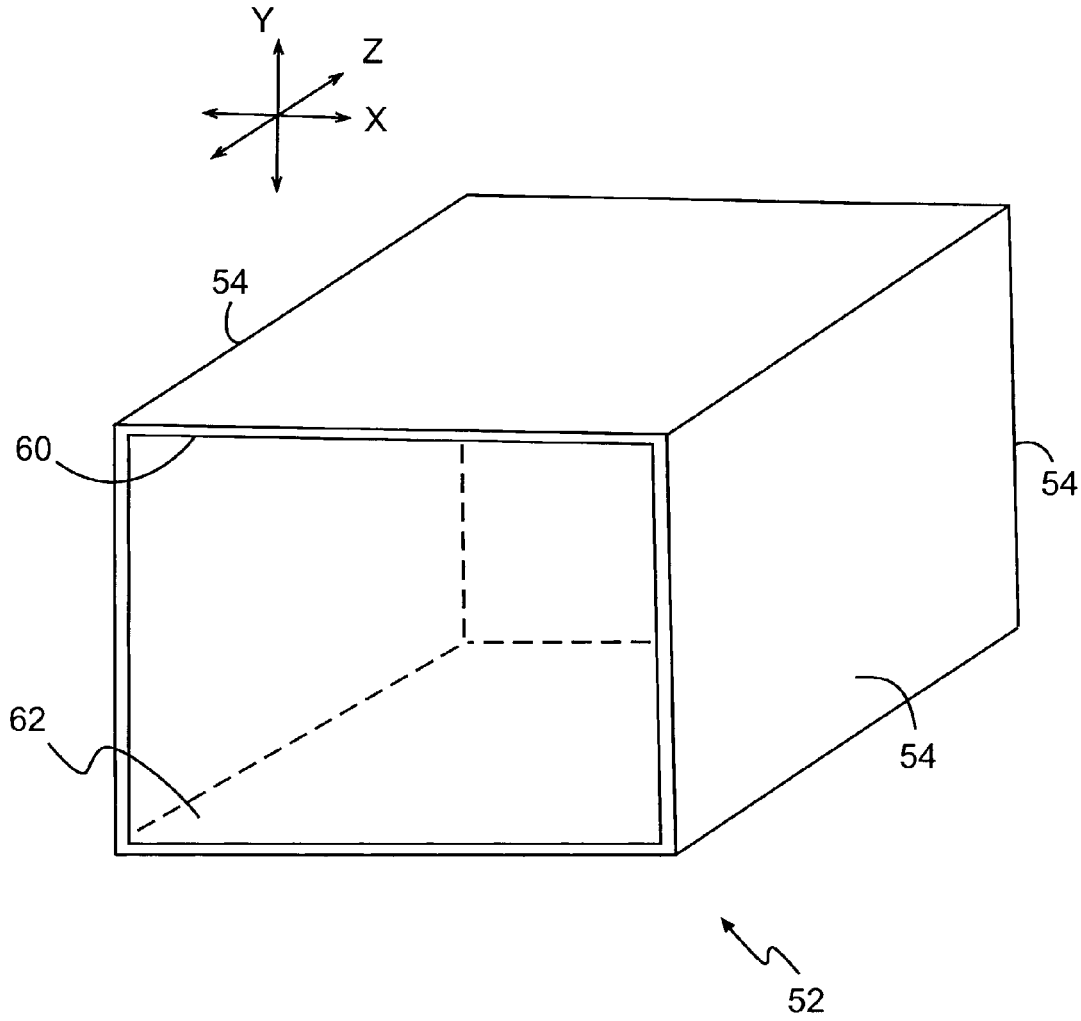
FIG. 11 illustrates an alternative preferred embodiment of an outer container.

FIG. 11 illustrates an alternative preferred embodiment of an outer container 52 shown in cut-away. The outer container 52 includes an inner top surface 60, an inner bottom surface 62, and side walls 54 that define a vertical ("y") axis. The inner top surface 60 and the inner bottom surface 62 are substantially fixedly spaced apart in the vertical axis as defined by the height of the side walls 54. The outer container 52 may have an open and closed configuration that is provided by a side wall 54 that is removable.

Figure 12:
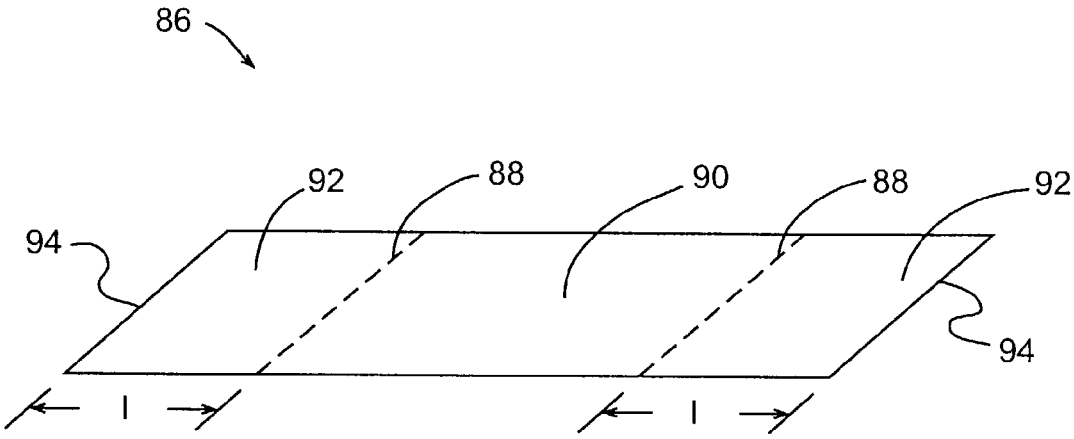
FIG. 12 illustrates a sheet member according to the present invention.
Figure 13:
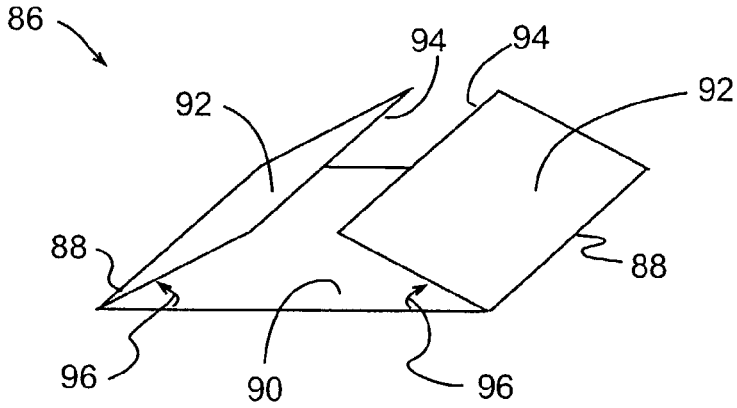
FIG. 13 illustrates the sheet member of FIG. 12 in a folded arrangement.

FIGS. 12–13 illustrate two views of a sheet member 86. In FIG. 12, the sheet member 86 is in the form of a corrugated board blank having two fold lines 88. The fold lines 88 define a bottom surface 90 and two preformed foldable portions 92. The fold lines 88 may be lines on or scores in the corrugated board blank. Additionally, each preformed foldable portion 92 has a free distal edge 94. FIG. 13 illustrates the sheet member 86 in an arrangement in which each preformed foldable portion 92 has been folded upward along its respective adjacent fold line 88. As shown, each preformed foldable portions 92 projects away from the bottom surface 90 at an angle 96 of approximately 30 degrees. The shown angle 96 is exemplary and any angle between 1 and 89 degrees is contemplated.

The fold lines 88 are preferably provided at the location shown in FIGS. 12, 13. However, the fold lines 88 may be closer to or farther away from the free distal edge 94. The location of the fold line 88 is defined by the length "1" of the preformed foldable portion 92. In addition, while it is essential that the sheet member have at least one pre-folded portion, it is preferable that the sheet member have at least two pre-folded portions.

Figure 14:
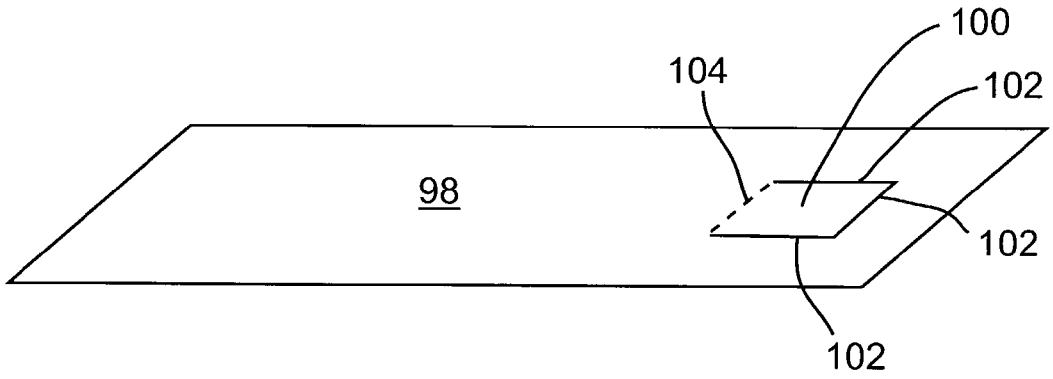
FIG. 14 illustrates an alternate embodiment of a sheet member according to the present invention.
Figure 15:
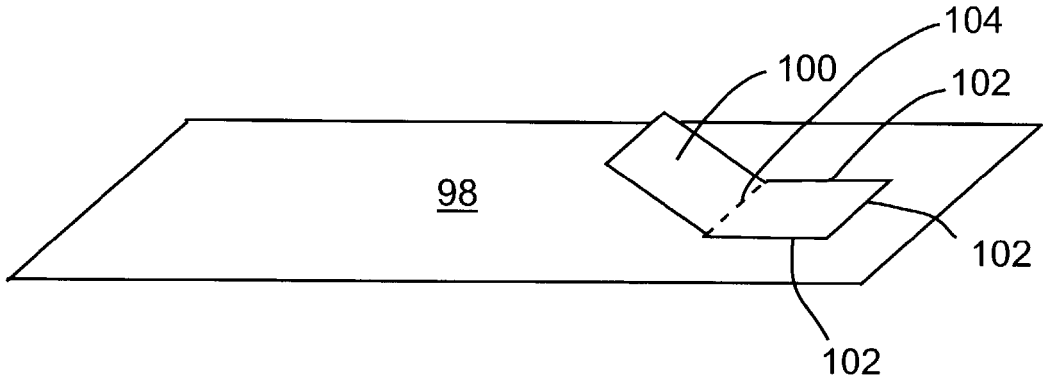
FIG. 15 illustrates the sheet member of FIG. 14 in a folded arrangement.

FIGS. 14, 15 illustrate a sheet member 98 having an alternative embodiment of the preformed foldable portion 100. In the shown embodiment, the preformed foldable portion 100 is defined within the sheet member 98. In FIG. 14, the sheet member 98 has three cut lines 102 that are cut into it and a transverse fold line 104. The material is separated along the cut lines 102 and folded about the fold line 104 to create a preformed foldable portion 100, as shown in FIG. 15.

Figure 16:
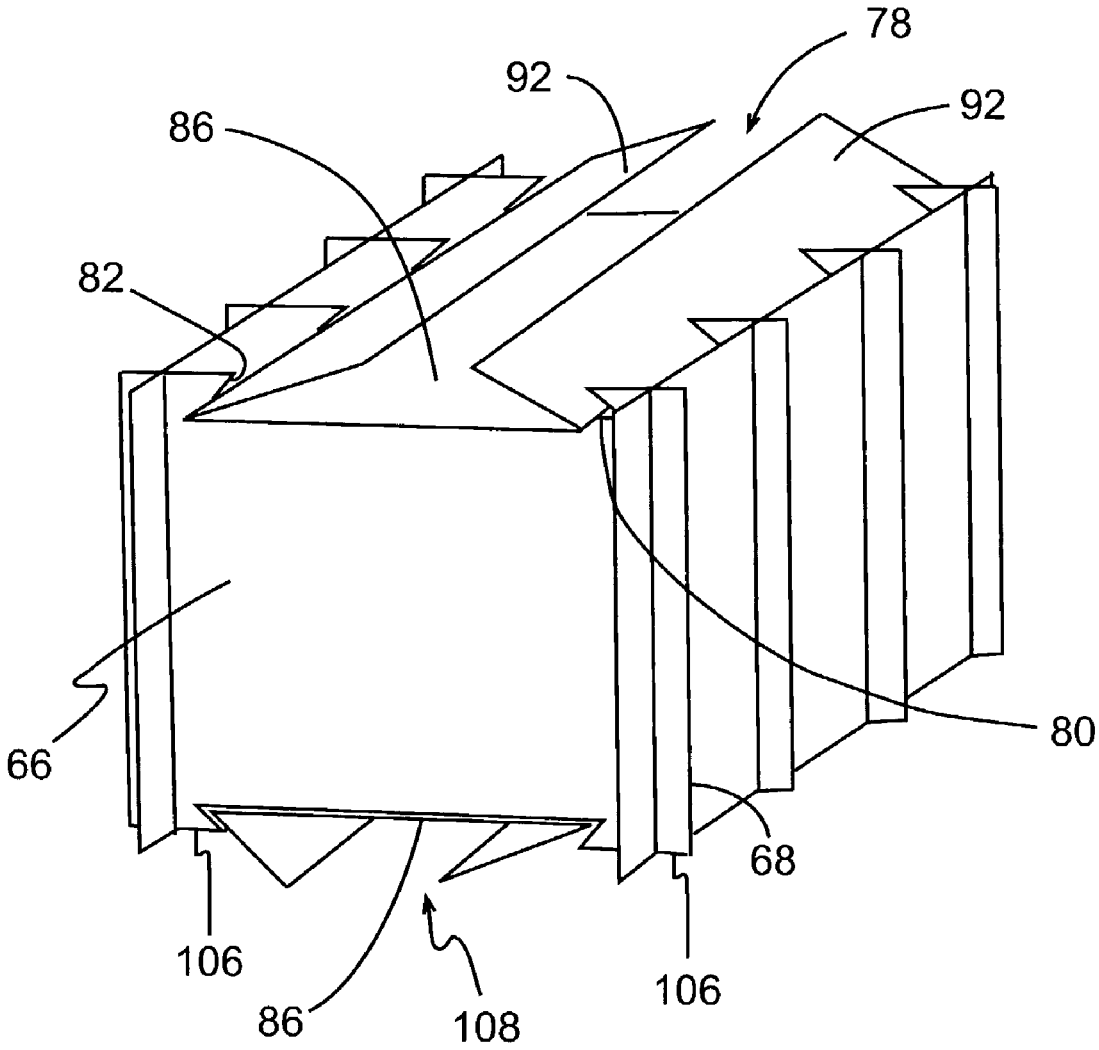
FIG. 16 illustrates two of the sheet members of FIG. 12 disposed within an article container according to the present invention.

FIG. 16 illustrates the sheet member 86 disposed within the sheet member holding recess 78 of an article container 66. The sheet member holding recess 78 captures the sheet member 86 thereby preventing side-to-side movement of the sheet member with respect to the article container 66. Referring to FIGS. 9 and 16, the sheet member holding recess 78 is preferably provided with an upper end 80, inclined edges 82, and acute angles 84 that define the relation between the upper end 80 and the inclined edges 82. The inclined edges 82 confine the preformed foldable portions 92 with respect to vertical movement. The bottom surface 90 of the sheet member 86 contacts the upper end 80 of the reverse notched partition 68. The article container 66 also has a plurality of lower ends that contact the bottom surface of the outer container 52 when the article container 66 is positioned within the outer container 52.

The article container 66 has an optional second sheet member 86 disposed within a lower sheet member holding recess 108. When the article container 66 is positioned within the outer container 52, the second sheet member holding recess 108 and the second sheet member 86 will be disposed adjacent to the inner bottom surface 58 of the outer container 52. This optional configuration protects against vertical forces and shocks from below the shock absorbing container assembly 50.

Figure 17:
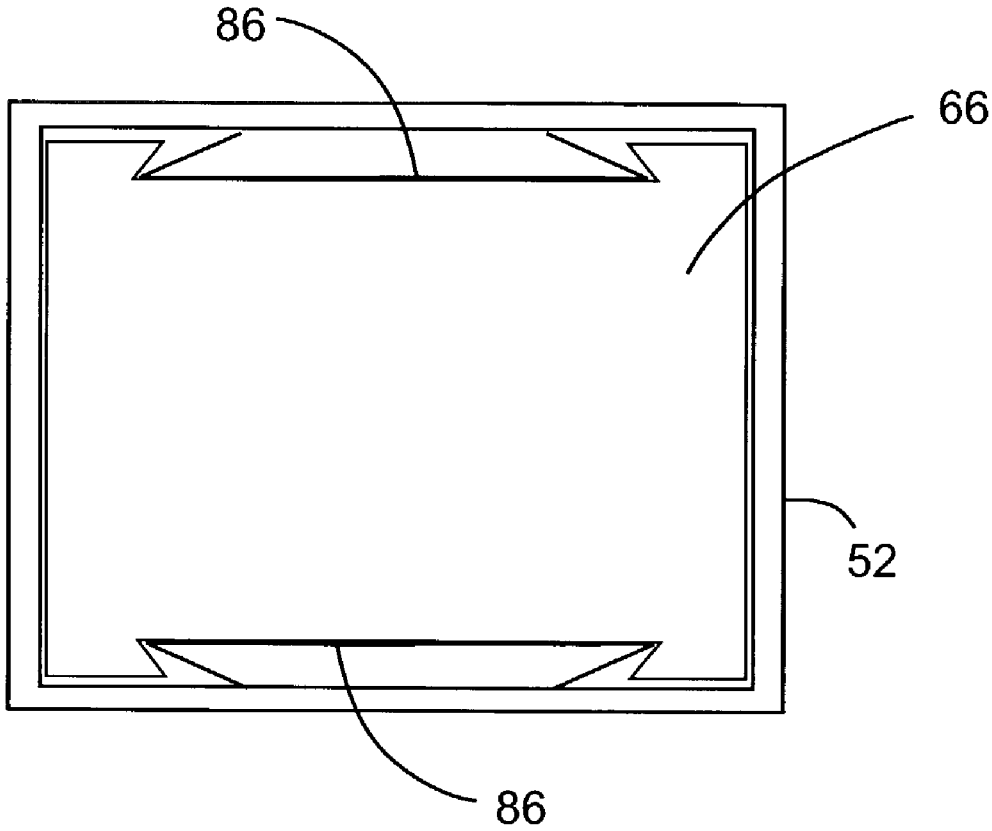
FIG. 17 is a cross-sectional view of the sheet members and article holding container of FIG. 16.

FIG. 17 shows, in cross-section, the article holding container 66 together with the two of the sheet members 86 of FIG. 16 disposed in an outer container 54.

When the article container 66 is disposed in the outer container 52 the free distal edges 94 may be in direct contact or close proximity to the inner top surface 60. When the outer container experiences a vertical force or shock, the inner top surface 60 contacts the free distal edges 94 and the preformed foldable portions 92 bend inward about fold line 88 providing cushioning. The preformed foldable portion 92 and the fold line 88 together effectively act as a spring. The strength of the spring is proportional to the length "l" of the preformed foldable portion 92.

The intended meaning of some of the terms and phrases used herein is discussed below.

The phrase "sheet member" 86, 98 refers to both the flat blank arrangements shown in FIGS. 12, 14 and the folded arrangements shown in FIGS. 13, 15. The sheet member can be shipped and stored in the flat blank arrangement for later assembly into the folded arrangement when needed. While the shown sheet member 86 is preferably made of corrugated board, it may be made from plastics, composites, or other materials.

The phrase "article holding container" refers to both the partitions shown in FIGS. 9–10 and the assembled article containers, such as those shown in FIGS. 8 and 16. The article holding container can be shipped and stored as unassembled partitions for later assembly into the article containers of FIGS. 8 and 16 when needed.

The phrase "free distal end" 94, with reference to the termination point of the pre-folded portion of the sheet member, means that the free distal end has enough freedom of movement to provide shock absorption. Complete freedom of movement of the pre-folded portion is not required. Any range of motion sufficient that allows the free distal end 94 to move in response to a shock is sufficient.

The word "vertical" is used herein only to provide a frame of reference for describing the invention. It will be appreciated that the invention can be easily adapted to provide shock absorption against a force or shock originating in any direction. For example, an article container with a sheet member holding recess (and a sheet member disposed therein) in a side wall will provide shock absorption in the horizontal direction.

The word "shipping," with reference to the outer container 52 in a closed configuration, refers to any situation in which the container assembly may be subjected to forces or shocks.

The phrase "fixedly spaced apart," with reference to the inner top surface and the inner bottom surface of the outer container, means that the top and bottom surfaces are spaced apart by a defined distance that does not vary in a substantial way under normal conditions. The phrase is not intended to contemplate that the surfaces are spaced apart by a precisely defined distance at all times. For example, a vertical force exerted downward on the lid 58 may cause it to bend. Similarly, a vertical force exerted downward on the lid 58 may result in a deformation, e.g., a dent. It is contemplated that an inner top or bottom surface may bend or be deformed and still be "fixedly spaced apart" from each other as this phrase is used herein.

The terms and expressions that have been employed in the foregoing specification are used as terms of description and not of limitation, and are not intended to exclude equivalents of the features shown and described or portions of them. The scope of the invention is defined and limited only by the claims that follow.

What is claimed is:

1. A shock absorbing container assembly for packaging one or more articles, comprising:

an outer container;

an inner container defining at least one cellular compartment for disposition inside said outer container, said compartment for receiving at least one of the articles and said outer container for completing an enclosure therefor; and a sheet member for disposition between said inner and outer containers, said sheet member comprising a substantially flat bottom portion for bearing on said inner container over a flat face of said bottom portion and a first, substantially flat foldable portion foldably connected to said bottom portion along a first linear line for folding away from said bottom portion and bearing on said outer container along a free distal edge of said first foldable portion;

wherein said free distal edge is substantially linear;

wherein said sheet member includes a second, substantially flat foldable portion hingedly connected to said bottom portion along a second linear line for folding away from said bottom portion and bearing on said outer container along a free distal edge of said second foldable portion, said first and second lines being substantially parallel;

wherein said inner container includes a plurality of said compartments for receiving a corresponding plurality of the articles;

wherein said inner container comprises a plurality of slotted, intersecting walls defining said compartments and at least two of said walls include cut-outs adapted for receiving said sheet member; and wherein each of said at least two walls includes two opposed, mirror-image cut-outs sharing a single first linear edge and having respective second linear edges defining respective acute angles with respect to said first linear edge.

2. The container assembly of claim 1, wherein said sheet member is formed of corrugated paperboard.

3. The container assembly of claim 2, wherein said walls are formed of corrugated paperboard.

4. The container assembly of claim 3, wherein said outer container is formed of corrugated paperboard.

5. A shock absorbing container assembly for packaging one or more articles, comprising:

an outer container;

an inner container defining at least one cellular compartment for disposition inside said outer container, said compartment for receiving at least one of the articles and said outer container for completing an enclosure therefor; and a sheet member for disposition between said inner and outer containers, said sheet member comprising a substantially flat bottom portion for bearing on said inner container over a flat face of said bottom portion and a first, substantially flat foldable portion foldably connected to said bottom portion along a first linear line for folding away from said bottom portion and bearing on said outer container along a free distal edge of said first foldable portion;

wherein said free distal edge is substantially linear;

wherein said inner container includes a plurality of said compartments for receiving a corresponding plurality of the articles;

wherein said inner container comprises a plurality of slotted, intersecting walls defining said compartments and at least two of said walls include cut-outs adapted for receiving said sheet member; and wherein each of said at least two walls includes two opposed, mirror-image cut-outs sharing a single first linear edge and having respective second linear edges defining respective acute angles with respect to said first linear edge.

6. The container assembly of claim 5, wherein said sheet member is formed of corrugated paperboard.

7. The container assembly linear of claim 6, wherein said walls are formed of corrugated paperboard.

8. The container assembly linear of claim 7, wherein said outer container is formed of corrugated paperboard.

9. A shock absorbing container assembly for packaging one or more articles, comprising:

an outer container;

an inner container defining at least one cellular compartment for disposition inside said outer container, said compartment for receiving at least one of the articles and said outer container for completing an enclosure therefor; and a sheet member for disposition between said inner and outer containers, said sheet member comprising a substantially flat bottom portion for bearing on said inner container over a flat face of said bottom portion and a first, substantially flat foldable portion foldably connected to said bottom portion along a first linear line for folding away from said bottom portion and bearing on said outer container along a free distal edge of said first foldable portion;

wherein said inner container comprises plurality of slotted, intersecting walls defining said compartments and at least two of said walls include cut-outs adapted for receiving said sheet member; and wherein each of said at least two walls includes two opposed, mirror-image cut-outs sharing a single first linear edge and having respective second linear edges defining respective acute angles with respect to said first linear edge.

10. The container assembly of claim 9, wherein said sheet member is formed of corrugated paperboard.

11. The container assembly of claim 10, wherein said walls are formed of corrugated paperboard.

12. The container assembly of claim 11, wherein said outer container is formed of corrugated paperboard.

* * * * *